US010395587B2

(12) United States Patent
Wang

(10) Patent No.: US 10,395,587 B2
(45) Date of Patent: Aug. 27, 2019

(54) METHOD AND APPARATUS FOR ESTABLISHING LUMINANCE COMPENSATION MODEL, METHOD AND APPARATUS FOR COMPENSATING FOR LUMINANCE OF DISPLAY SCREEN, AND DISPLAY DEVICE

(71) Applicant: BOE TECHNOLOGY GROUP CO., LTD., Beijing (CN)

(72) Inventor: Yu Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/560,053

(22) PCT Filed: Apr. 5, 2017

(86) PCT No.: PCT/CN2017/079440

§ 371 (c)(1),
(2) Date: Sep. 20, 2017

(87) PCT Pub. No.: WO2017/215321

PCT Pub. Date: Dec. 21, 2017

(65) Prior Publication Data

US 2018/0182285 A1 Jun. 28, 2018

(30) Foreign Application Priority Data

Jun. 17, 2016 (CN) ..... 2016 1 0440206

(51) Int. Cl.
*G09G 3/3225* (2016.01)
*G09G 5/10* (2006.01)
*G09G 3/3208* (2016.01)

(52) U.S. Cl.
CPC ..... *G09G 3/3225* (2013.01); *G09G 3/3208* (2013.01); *G09G 5/10* (2013.01);
(Continued)

(58) Field of Classification Search
CPC ..... G09G 3/3225
See application file for complete search history.

(56) References Cited

U.S. PATENT DOCUMENTS

2006/0267871 A1* 11/2006 Seong ..... G09G 3/2022 345/63
2013/0147693 A1 6/2013 Bae
2016/0267838 A1* 9/2016 Zhang ..... G09G 3/2003

FOREIGN PATENT DOCUMENTS

CN 1519796 A 8/2004
CN 101291558 A 10/2008
(Continued)

OTHER PUBLICATIONS

International Search Report, Application No. PCT/CN2017/079440, dated May 27, 2017, 5 pgs.
(Continued)

*Primary Examiner* — Nelson M Rosario
*Assistant Examiner* — Scott Au
(74) *Attorney, Agent, or Firm* — Armstrong Teasdale LLP

(57) ABSTRACT

The present disclosure provides a method and an apparatus for establishing a luminance compensation model, a method and an apparatus for compensating for the luminance of a display screen, and a display device. The method for establishing a luminance compensation model for compensating for the luminance of a display screen includes acquiring an accumulated light emission amount of the display screen, if the accumulated light emission amount of the display screen falls within one of a plurality of predefined threshold intervals of light emission amount, determining a luminance compensation coefficient for the display screen corresponding to the one threshold interval of light emission amount, and establishing a luminance compensation model, which indicates a correlation between each of the plurality of
(Continued)

threshold intervals of light emission amount and the corresponding luminance compensation coefficient.

15 Claims, 6 Drawing Sheets

(52) U.S. Cl.
CPC ..... *G09G 2320/0233* (2013.01); *G09G 2320/045* (2013.01); *G09G 2320/048* (2013.01); *G09G 2360/145* (2013.01)

(56) References Cited

FOREIGN PATENT DOCUMENTS

| | | | | | |
|---|---|---|---|---|---|
| CN | 102708837 | A | | 10/2012 | |
| CN | 104021759 | | * | 9/2014 | ..... G09G 3/32 |
| CN | 104021759 | A | | 9/2014 | |
| CN | 104021773 | A | | 9/2014 | |
| CN | 105448245 | A | | 3/2016 | |
| CN | 105895056 | A | | 8/2016 | |
| JP | 2007240801 | A | | 9/2007 | |

OTHER PUBLICATIONS

PCT (CN) Written Opinion, Application No. PCT/CN2017/079440, dated May 27, 2017, 11 pgs.: with English translation.
China First Office Action, Application No. 201610440206.5, dated Nov. 28, 2016, 15 pgs.: with English translation.

* cited by examiner

METHOD AND APPARATUS FOR ESTABLISHING LUMINANCE COMPENSATION MODEL, METHOD AND APPARATUS FOR COMPENSATING FOR LUMINANCE OF DISPLAY SCREEN, AND DISPLAY DEVICE

CROSS REFERENCE TO RELATED APPLICATIONS

This patent application is a National Stage Entry of PCT/CN2017/079440 filed on Apr. 5, 2017, which claims the benefit and priority of Chinese Patent Application No. 201610440206.5 filed on Jun. 17, 2016, the disclosures of which are incorporated herein by reference in their entirety as part of the present application.

BACKGROUND

The present disclosure relates to display technologies for screens, and more particularly, to a method and an apparatus for establishing a luminance compensation model for compensating for the luminance of a display screen, a method and an apparatus for compensating for the luminance of a display screen, and a display device.

Organic light Emitting Diode (OLED) display devices have spatial and temporal nonuniformity problems under the current manufacturing process conditions. As the size of the display devices becomes larger, more such problems are revealed. Therefore, to address the display nonuniformity of the large-size OLED display device has become one of indispensable key technologies in mass production. The display nonuniformity of the OLED display device is closely relevant to the manufacturing process. If values of the threshold voltages on the entire panel are greatly different, the luminance uniformity of the display device as a whole is deteriorated. In addition, the organic material used also has a problem that the luminance thereof is constantly changing (for example, the luminance gradually decreases) during its own life.

At present, display device manufacturers can use professional equipment to compensate for the luminance of a display device. This means that once a display device is sold, the display device used by the user will display pictures always at the luminance compensation value before leaving the factory. However, with the gradual aging of the display device, it is clear that the luminance compensation value before leaving the factory can no longer guarantee that the display device maintains a normal display luminance, making the display effect of the display device gradually decreased.

BRIEF DESCRIPTION

The present disclosure provides a method and an apparatus for establishing a luminance compensation model for compensating for the luminance of a display screen, a method and an apparatus for compensating for the luminance of a display screen, and a display device.

A first aspect of the present disclosure provides a method for establishing a luminance compensation model for compensating for the luminance of a display screen. The method includes acquiring an accumulated light emission amount of the display screen, if the accumulated light emission amount of the display screen falls within one of a plurality of predefined threshold intervals of light emission amount, determining a luminance compensation coefficient for the display screen corresponding to the one threshold interval of light emission amount, and establishing the luminance compensation model, which indicates a correlation between each of the plurality of threshold intervals of light emission amount and the corresponding luminance compensation coefficient.

In an embodiment of the present disclosure, during determining the luminance compensation coefficient for the display screen corresponding to the one threshold interval of light emission amount, in the case that multiple accumulated light emission amounts fall within the one threshold interval of light emission amount, the luminance compensation coefficient is determined when one of the multiple accumulated light emission amounts falls within the one threshold interval of light emission amount, as the luminance compensation coefficient for the display screen corresponding to the one threshold interval of light emission amount, or the luminance compensation coefficient is determined when each of the multiple accumulated light emission amounts falls within the one threshold interval of light emission amount, and a weighted average of the determined luminance compensation coefficients is calculated to be used as the luminance compensation coefficient for the display screen corresponding to the one threshold interval of light emission amount.

In an embodiment of the present disclosure, during determining the luminance compensation coefficient, the display screen is controlled to display an image according to a preset display parameter, an actual luminance of the display screen for displaying the image is determined, and the luminance compensation coefficient is determined according to the actual luminance and a theoretical luminance, wherein the theoretical luminance is a luminance at which the display screen should theoretically display under the preset display parameter.

In an embodiment of the present disclosure, during acquiring the accumulated light emission amount of the display screen, for each frame image, a sum of display gray scales of all sub-pixels of the display screen is calculated, and the sums of the display gray scales for the respective frame images are added at a predetermined time interval, to acquire an accumulated display gray scale as the accumulated light emission amount of the display screen.

A second aspect of the present disclosure provides a method for compensating the luminance of a display screen. The method includes acquiring a accumulated light emission amount of the display screen, determining a threshold interval of light emission amount corresponding to the accumulated light emission amount of the display screen, determining a luminance compensation coefficient corresponding to the determined threshold interval of light emission amount, by using the luminance compensation model established by the method for establishing a luminance compensation model for compensating for the luminance of a display screen according to the present disclosure, and compensating for the luminance of the display screen based on the determined luminance compensation coefficient.

In an embodiment of the present disclosure, the method further includes further determining whether the accumulated light emission amount of the display screen falls within another threshold interval of light emission amount, after compensating for the luminance of the display screen, if the accumulated light emission amount of the display screen falls within the another threshold interval of light emission amount, determining the luminance compensation coefficient corresponding to the another threshold interval of light emission amount by using the luminance compensation model, and compensating for the luminance of the display screen based on the determined luminance compensation coefficient, if the accumulated light emission amount of the display screen does not fall within the another threshold interval of light emission amount, maintaining the compensation coefficient of the display screen.

In an embodiment of the present disclosure, during acquiring the accumulated light emission amount of the display screen, gray scales of all sub-pixels of the display screen in each frame image are acquired from driving data for displaying an image of the display screen, for each frame image, a sum of the display gray scales of all sub-pixels of the display screen is calculated, and the sums of the display gray scales for the respective frame images are added at a predetermined time interval to acquire an accumulated display gray scale as the accumulated light emission amount of the display screen.

A third aspect of the present disclosure provides an apparatus for establishing a luminance compensation model for compensating for the luminance of a display screen. The apparatus includes at least one processor and at least one memory in which a computer program is stored. When executed by the at least one processor, the computer program enables the apparatus to acquire an accumulated light emission amount of the display screen, and if the accumulated light emission amount of the display screen falls within one of a plurality of predefined threshold intervals of light emission amount, determine a luminance compensation coefficient for the display screen corresponding to the one threshold interval of light emission amount, and establish the luminance compensation model, which indicates a correlation between each of the plurality of threshold intervals of light emission amount and the corresponding luminance compensation coefficient.

A fourth aspect of the present disclosure provides an apparatus for compensating for the luminance of a display screen. The apparatus includes at least one processor and at least one memory in which a computer program is stored. When executed by the at least one processor, the computer program enables the apparatus to acquire an accumulated light emission amount of the display screen, determine a threshold interval of light emission amount corresponding to the accumulated light emission amount of the display screen, determine a luminance compensation coefficient corresponding to the determined threshold interval of light emission amount by using the luminance compensation model established by the method for establishing a luminance compensation model for compensating for the luminance of a display screen according to the present disclosure, and compensate for the luminance of the display screen based on the determined luminance compensation coefficient.

A fifth aspect of the present disclosure provides an apparatus for compensating for the luminance of a display screen. The apparatus includes an accumulated light emission amount acquisition module configured to acquire an accumulated light emission amount of the display screen, a processing module configured to determine a threshold interval of light emission amount corresponding to the accumulated light emission amount of the display screen, and determine a luminance compensation coefficient corresponding to the determined threshold interval of light emission amount by using the luminance compensation model established by the method for establishing a luminance compensation model for compensating for the luminance of a display screen according to the present disclosure, and a compensation module configured to compensate for the luminance of the display screen based on the determined luminance compensation coefficient.

In an embodiment of the present disclosure, the processing module is further configured to determine, for the display screen after being compensated for, whether the accumulated light emission amount of the display screen falls within another predefined threshold interval of light emission amount, and in response to determining that the accumulated light emission amount falls within the another threshold interval of light emission amount, determine the luminance compensation coefficient corresponding to the another threshold interval of light emission amount by using the luminance compensation model.

In an embodiment of the present disclosure, the accumulated light emission amount acquisition module includes an acquisition unit configured to acquire, from driving data for displaying an image of the display screen, gray scales of all sub-pixels of the display screen in each frame image, a first calculation unit configured to, for each frame image, calculate a sum of the display gray scales of all sub-pixels of the display screen, and a second calculation unit configured to add the sums of the display gray scales for the respective frame images at a predetermined time interval to acquire an accumulated display gray scale as the accumulated light emission amount of the display screen.

A sixth aspect of the present disclosure provides a display device including an apparatus referred to herein for compensating for the luminance of a display screen.

Further adaptive aspects and ranges are apparent from the description provided herein. It is to be understood that various aspects of the present application may be implemented individually or in combination with one or more other aspects. It is also to be understood that the description and specific embodiments herein are for the purpose of illustration only and are not intended to limit the scope of the present application.

BRIEF DESCRIPTION OF THE DRAWINGS

In order to more clearly illustrate the technical solutions of the embodiments of the present disclosure, the drawings of the embodiments will be briefly described below, and it should be understood that the drawings described below relate only to some embodiments of the present disclosure and are not intended to limit the present disclosure, wherein.

DETAILED DESCRIPTION

Various embodiments will now be described in detail with reference to the accompanying drawings, which are provided as exemplary examples of the present disclosure to enable those skilled in the art to implement the present disclosure.

It is to be noted that the flow charts depicted in the present disclosure are merely examples. Numerous variants of the flow charts or the steps described therein may be present, without departing from the spirit of the present disclosure. For example, the steps may be performed in a different order, or the steps may be added, deleted, or modified. These variants are considered to be part of the claimed aspects.

According to the embodiments of the present disclosure, the luminance compensation model of the display screen is established by evaluating the aging stage of the display screen (corresponding to the threshold interval of light emission amount within which the accumulated light emission amount falls) with the accumulated light emission amount and determining the luminance compensation coefficient corresponding to each aging stage. Based on the established luminance compensation model, it is possible to compensate for the luminance of the display screen on the user side. Specifically, the display effect of the display device may be improved by evaluating in which stage the aging degree of the display screen is through the light emission amount of the screen, and thereafter by acquiring an appropriate luminance compensation coefficient for the display screen based on the luminance compensation model to compensate for the luminance of the display screen, on the user side.

Figure 1:
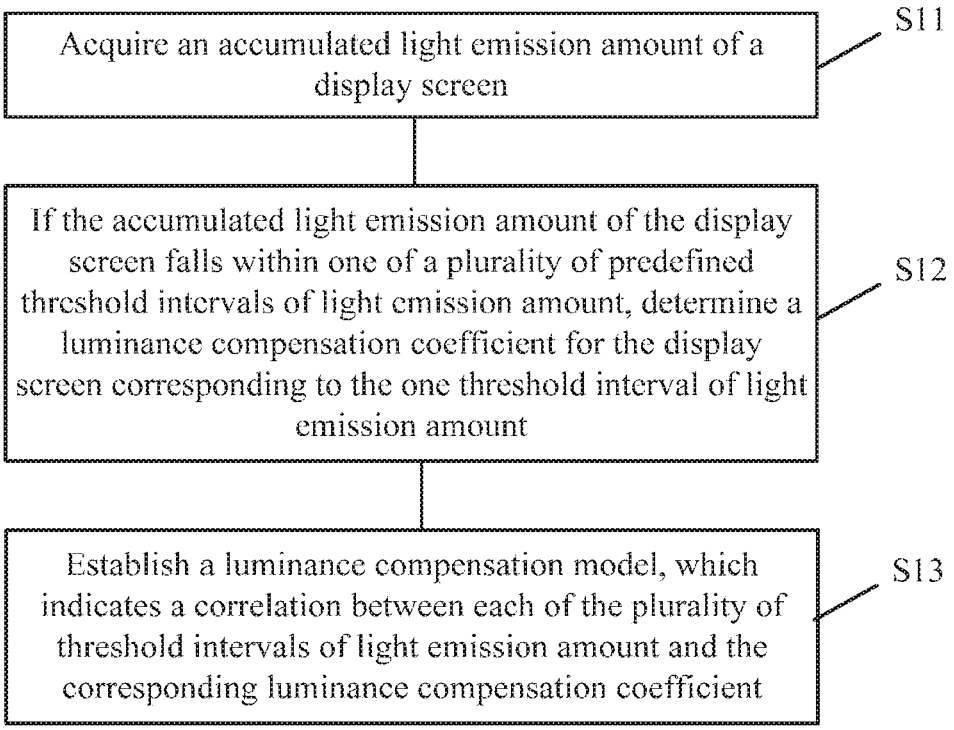
FIG. 1 shows a flow chart of a method for establishing a luminance compensation model for compensating for the luminance of a display screen according to an embodiment of the present disclosure.

FIG. 1 shows a flow chart of a method for establishing a luminance compensation model for compensating for the luminance of a display screen according to an embodiment of the present disclosure. As shown in FIG. 1, the method includes steps S11-S13.

At step S11, an accumulated light emission amount of the display screen is acquired. At step S12, if the accumulated light emission amount of the display screen falls within one of a plurality of predefined threshold intervals of light emission amount, a luminance compensation coefficient for the display screen corresponding to the one threshold interval of light emission amount is determined. At step S13, a luminance compensation model is established, which indicates a correlation between each of the plurality of threshold intervals of light emission amount and the corresponding luminance compensation coefficient.

In an embodiment of the present disclosure, some display screens may be pre-produced before the mass production of the display screen as test screens so as to establish the luminance compensation model. It is to be understood that in practical applications, the more test screens are used for testing, the more representative the finally acquired results.

The method for establishing the luminance compensation model for compensating for the luminance of the display screen in the embodiment shown in FIG. 1 will be described below in detail with reference to FIGS. 2 and 3.

At step S11 in FIG. 1, the light emission amount of the display screen may be accumulated at a predetermined time interval. For example, the light emission amount of the display screen may be accumulated at an interval of one frame, that is, the light emission amount of the display screen in each frame is summed, so as to acquire the accumulated light emission amount. It should be understood that other time intervals, such as 10 frames, may also be set.

Figure 2:
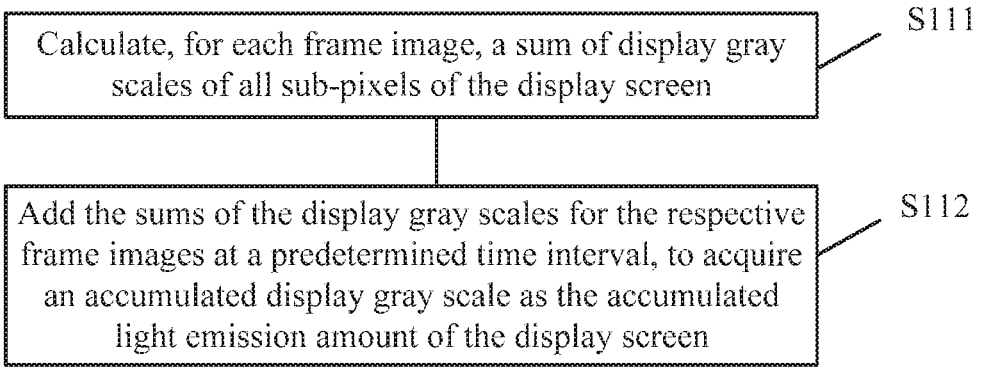
FIG. 2 shows an exemplary flow chart of a process of acquiring the accumulated light emission amount of the display screen in the embodiment shown in FIG. 1.
Figure 3:
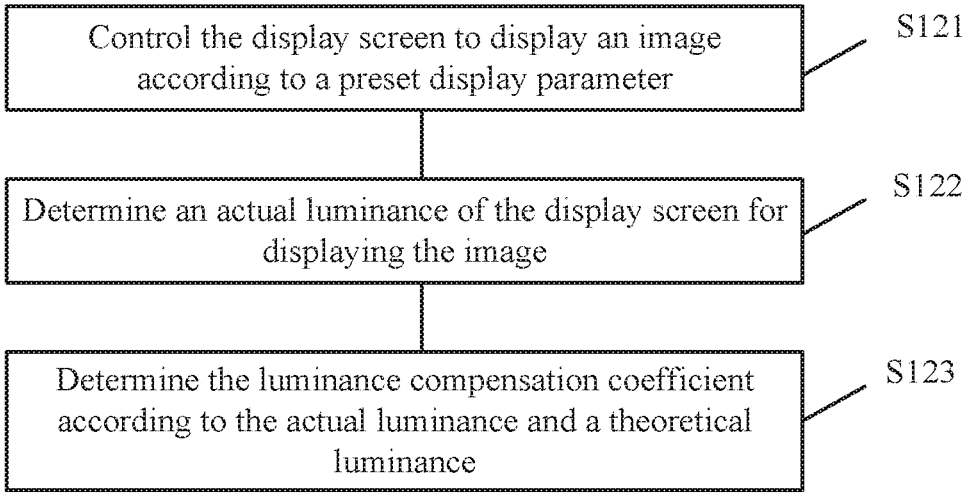
FIG. 3 shows an exemplary flow chart of a process of determining a luminance compensation coefficient in the embodiment shown in FIG. 1.

FIG. 2 shows an exemplary flow chart of the process of acquiring the accumulated light emission amount of the display screen (step S11) in the embodiment shown in FIG. 1. As shown in FIG. 2, at step S111, for each frame image, a sum of display gray scales of all sub-pixels of the display screen is calculated. In this embodiment, the display gray scales of the sub-pixels may be acquired from driving data of the display screen. At step S112, the sums of the display gray scales for the respective frame images are added at a predetermined time interval to acquire an accumulated display gray scale as the accumulated light emission amount of the display screen.

It will be appreciated that the display gray scale of a sub-pixel may reflect the luminance level of the sub-pixel. In each frame, the sum of the gray scales of all sub-pixels on the screen may reflect the light emission amount of the screen at the frame. Thus, by adding the display gray scales of each frame image, the accumulated light emission amount of the display screen may be reflected. Since the accumulated light emission amount is generated during the operation of the display screen, it may reasonably reflect the aging degree of the screen.

In an embodiment of the present disclosure, a plurality of threshold intervals of light emission amount may be predefined. The plurality of threshold intervals of light emission amount have different ranges of values, respectively. For example, the range of the first threshold interval of light emission amount may be set to be 1001-1500 (in arbitrary units), and the range of the second threshold interval of light emission amount may be set to be 1501-2000. It is to be understood that these threshold intervals of light emission amount may also have different interval lengths (interval widths), for example, the first threshold interval of light emission amount is 1001-2000 and the second threshold interval of light emission amount is 2001-2500.

It is also to be noted that a start value of the first interval of the predefined plurality of threshold intervals of light emission amount and an end value of the last interval may be determined based on, for example, the hardware and/or software configuration of the display screen and/or the experience of the developer. As an example, in the case that the total time of the display screen used is short, there is no need for luminance compensation. Therefore, in the embodiment of the present disclosure, the start value of the first threshold interval of light emission amount may be set greater than a certain threshold, for example, 1000. It is also understood that in the case that the total time of the display screen used is relatively long, it is difficult to achieve the desired display effect even by a luminance compensation, due to the hardware aging of the display screen, and in this case, the display screen is about to be scrapped, and it is also not necessary to perform a luminance compensation. Accordingly, the end value of the last threshold interval of light emission amount may be set not more than a certain threshold, for example, 100000.

At step S12 of FIG. 1, if the accumulated light emission amount of the display screen reaches one of the plurality of threshold intervals of light emission amount, it is possible to calculate the luminance compensation coefficient corresponding to the threshold interval of light emission amount where the accumulated light emission amount of the display screen is present, and the luminance compensation coefficient may be used to compensate for the luminance of the display screen.

At the step S12, selectively, if multiple accumulated light emission amounts fall within a same threshold interval of light emission amount, the luminance compensation coefficient may be determined when one of the multiple accumulated light emission amounts falls within the same threshold interval of light emission amount, as the luminance compensation coefficient for the display screen corresponding to the same threshold interval of light emission amount, alternatively, the luminance compensation coefficient is determined when each of the multiple accumulated light emission amounts falls within the same threshold interval of light emission amount, and then a weighted average value of the determined luminance compensation coefficients is calculated as the luminance compensation coefficient for the display screen corresponding to this threshold interval of light emission amount.

By way of example, in the case that multiple accumulated light emission amounts fall within the same threshold interval of light emission amount, a luminance compensation coefficient may be determined, when the first of the multiple accumulated light emission amounts reaches this threshold interval of light emission amount, as the luminance compensation coefficient corresponding to this threshold interval of light emission amount, alternatively, a luminance compensation coefficient may be determined when the last of the multiple accumulated light emission amounts falls within this threshold interval of light emission amount, as the luminance compensation coefficient corresponding to this threshold interval of light emission amount, and further alternatively, the luminance compensation coefficient may be determined when each of the multiple accumulated light emission amounts located within this threshold interval of light emission amount, and then a weighted average of the plurality of luminance compensation coefficients may be determined as the luminance compensation coefficient corresponding to this threshold interval of light emission amount. It will be appreciated that other embodiments are also possible.

In embodiments of the present disclosure, any method may be used to determine the luminance compensation coefficient for the display screen. As an example, the luminance compensation coefficient for the display screen may be calculated based on the difference between the theoretical luminance and the actual luminance of the display screen. Of course, other embodiments are also possible. FIG. 3 shows an exemplary flow chart of the process of determining the luminance compensation coefficient (step S12) in the embodiment shown in FIG. 1. At step S121, the display screen is controlled to display an image according to the preset display parameter, at step S122, an actual luminance of the display screen to display the image is determined, at step S123, the luminance compensation coefficient is determined based on the actual luminance and the theoretical luminance. In this embodiment, the theoretical luminance may be a luminance at which the display screen should theoretically display under the preset display parameter, for example, the theoretical luminance may be an initial display luminance under the preset display parameter when the display screen has just been produced, or may also be a desired display luminance of the display screen under the preset display parameter.

In an embodiment, the luminance compensation coefficient may be used to adjust the display parameter of the display screen so that the display parameter of the display screen is adjusted to a value that enables the actual luminance of the display screen to coincide with the theoretical luminance.

As an example, if the actual luminance displayed by the display screen according to the preset display parameter is lower than the theoretical luminance under the display parameter, a luminance compensation coefficient is determined first based on the existing luminance compensation algorithm, and the display parameter of the display screen is adjusted based on this luminance compensation coefficient, so as to control the display screen to display the test image using the adjusted display parameter. If the adjusted actual luminance may reach the theoretical luminance, the luminance compensation coefficient is applied to the luminance compensation model, conversely, if the adjusted actual luminance does not reach the theoretical luminance, the luminance compensation coefficient may be re-adaptively increased, and the display parameter is adjusted again, until the actual luminance of the display screen coincides with the theoretical luminance.

In embodiments of the present disclosure, the display parameter may be the display gray scale of the sub-pixel. As an example, the preset display gray scale level is 100, and under normal circumstances, the theoretical luminance that can be displayed by the display screen at the display gray scale level of 100 is level 100. However, since the light emission amount of the display screen is accumulated to an aging stage, in the case of the gray scale level of 100, only the actual luminance of level 80 is displayed. In this case, the display gray scale at which the display screen operates may be adjusted from level 100 to level 120. According to the adjusted level of gray scale, if the actual luminance of level 100 can be outputted, the luminance compensation is considered to be successful, and the luminance compensation coefficient used to adjust the display gray scale from level 100 to level 120 is stored in the luminance compensation model.

At step S13 in FIG. 1, a luminance compensation model may be established based on the threshold interval of light emission amount and the luminance compensation coefficient, and the luminance compensation model indicates the correlation between each of the threshold intervals of light emission amount and the corresponding luminance compensation coefficient. In this embodiment, the luminance compensation model may be stored in a memory of a display device to compensate for the luminance of the display screen during the user's use of the display screen.

In embodiments of the present disclosure, different threshold intervals of light emission amount may represent different aging stages of the screen, and different aging stages each correspond to one luminance compensation coefficient determined by the manufacturer using a professional testing device. Therefore, on the user side, it is only necessary to find the aging stage of the display screen (i.e., the threshold interval of light emission amount) from the luminance compensation model and the luminance compensation coefficient corresponding to the aging stage, then the display parameter of the driving circuit of the display screen may be adjusted so as to implement a luminance compensation on the display screen.

Figure 4:
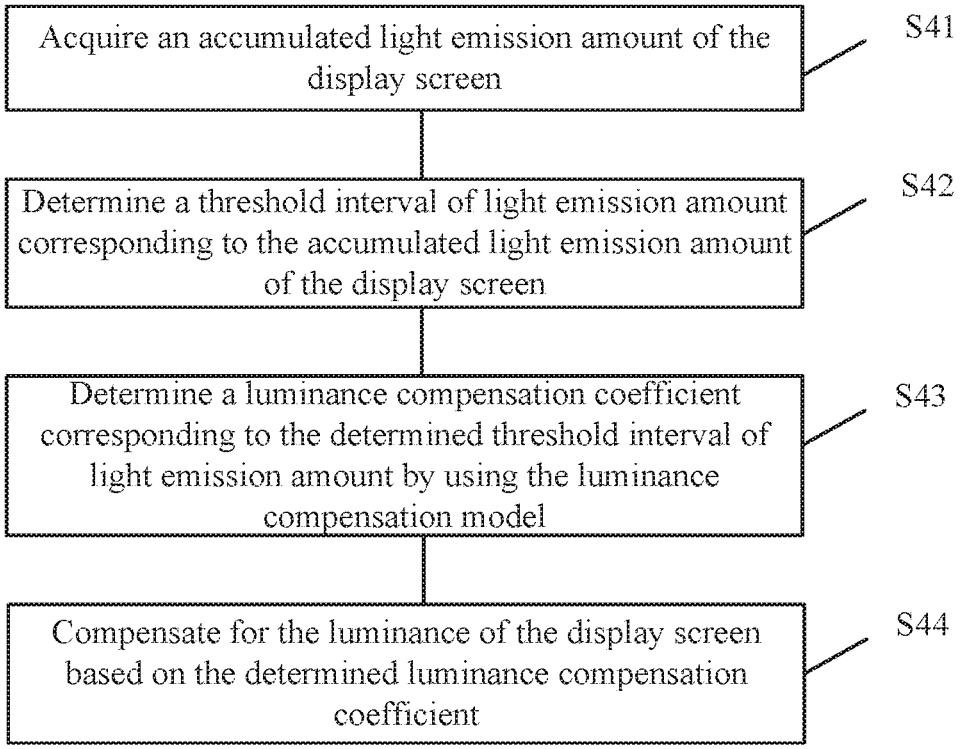
FIG. 4 shows a flow chart of a method for compensating for the luminance of a display screen according to an embodiment of the present disclosure.

FIG. 4 shows a flow chart of a method for compensating for the luminance of a display screen according to an embodiment of the present disclosure. As shown in FIG. 4, the method may include steps S41-S44. At step S41, an accumulated light emission amount of the display screen is acquired. At step S42, a threshold interval of light emission amount corresponding to the accumulated light emission amount of the display screen is determined. At step S43, a luminance compensation coefficient corresponding to the determined threshold interval of light emission amount is determined by using a luminance compensation model established according to one or more embodiments relating to the method for establishing the luminance compensation model for compensating for the luminance of the display screen. At step S44, the luminance of the display screen is compensated for based on the determined luminance compensation coefficient. In an exemplary embodiment, a display parameter of the display screen may be adjusted based on the determined luminance compensation coefficient such that the display parameter is adjusted to a value that enables the actual luminance of the display screen to coincide with the theoretical luminance.

The present embodiment may evaluate the aging stage of the display screen on the user side through the accumulated light emission amount of the display screen, and then acquire the luminance compensation coefficient corresponding to the current aging stage of the display screen using the established luminance compensation model, so as to perform a luminance compensation on the display screen.

Figure 5:
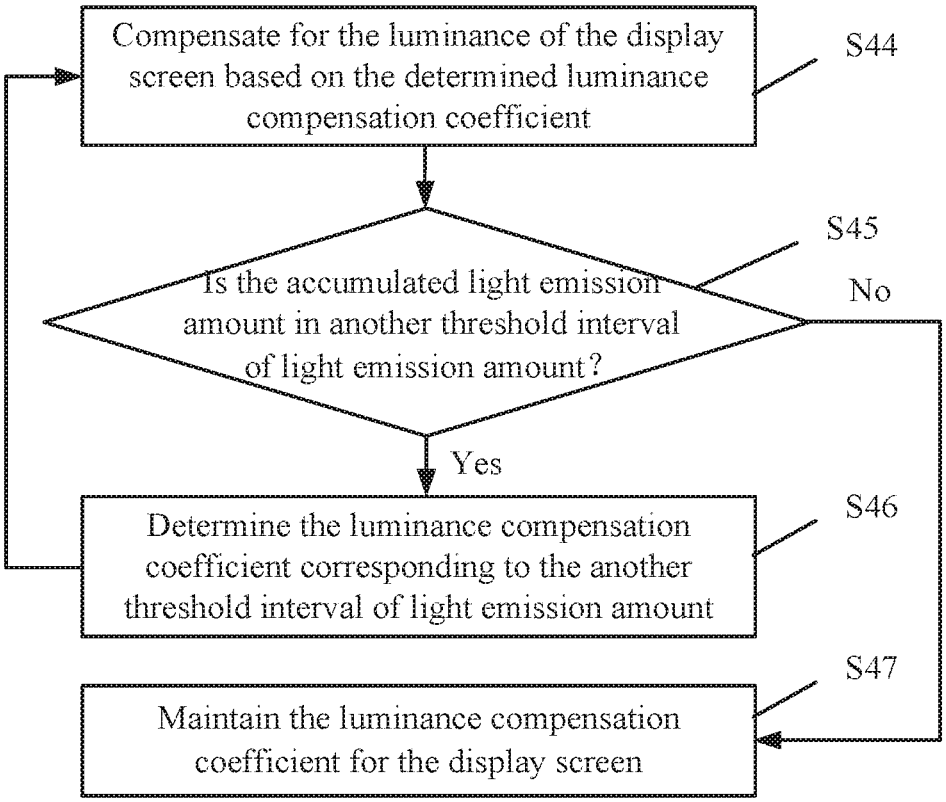
FIG. 5 shows an exemplary flow chart of dynamic compensation of the luminance of the display screen.
Figure 6:
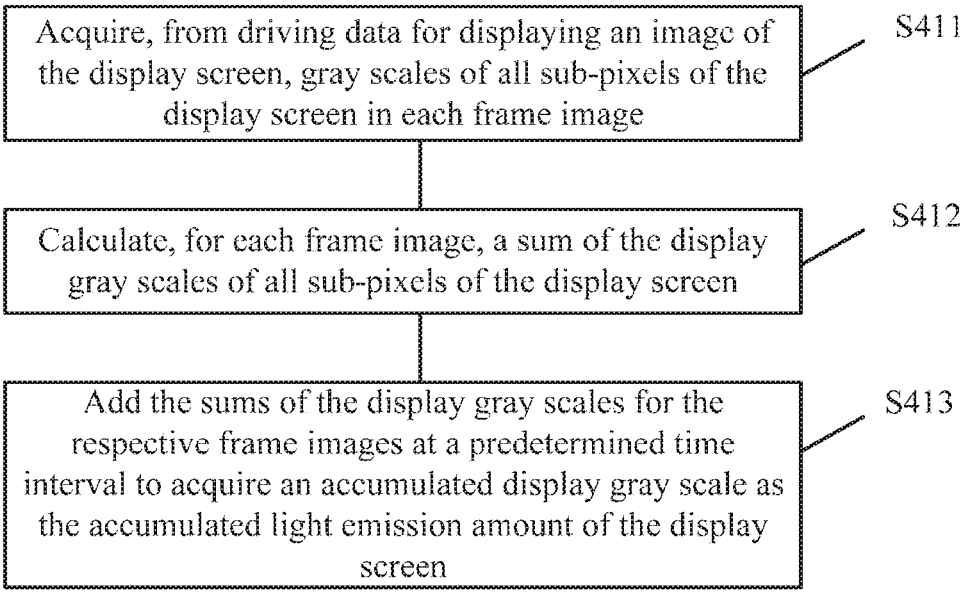
FIG. 6 shows an exemplary flow chart of a process of acquiring the accumulated light emission amount of the display screen in the embodiment shown in FIG. 4.

The method for compensating for the luminance of the display screen in the embodiment shown in FIG. 4 will be described below in detail with reference to FIGS. 5 to 7.

In an embodiment of the present disclosure, the luminance of the display screen may be dynamically compensated for according to the aging degree of the screen. FIG. 5 shows an exemplary flow chart of dynamic compensation of the luminance of the display screen. As shown in FIG. 5, after compensating for the luminance of the display screen, the method may further include steps S45-S47.

At step S45, it is further determined whether the accumulated light emission amount of the display screen is in another threshold interval of light emission amount.

At step S46, in response to determining that the accumulated light emission amount of the display screen is in the another threshold interval of light emission amount, the luminance compensation coefficient corresponding to the another threshold interval of light emission amount is determined by using the luminance compensation model, and then the luminance of the display screen is compensated for based on the determined luminance compensation coefficient (S44).

At step S47, in response to the accumulated light emission amount of the display screen being not in another threshold interval of light emission amount, the luminance compensation coefficient for the display screen is maintained.

Obviously, based on the dynamic luminance compensation scheme, the screen on the user side may be maintained at a substantially ideal luminance level, thereby improving the quality of the product.

In an embodiment of the present disclosure, the accumulated light emission amount of the display screen may be acquired according to the display gray scale of each sub-pixel of the display screen. FIG. 6 shows an exemplary flow chart of the process of acquiring the accumulated light emission amount of the display screen (step S41) in the embodiment shown in FIG. 4. As shown in FIG. 6, at step S411, display gray scales of all sub-pixels of the display screen in each frame are acquired from driving data of the display screen for displaying an image, at step S412, for each frame image, a sum of the display gray scales of all sub-pixels of the display screen is calculated, and at step S413, the sums of the display gray scales for the respective frame images are added at a predetermined time interval to acquire the accumulated gray scale as the accumulated light emission amount of the display screen.

Figure 7:
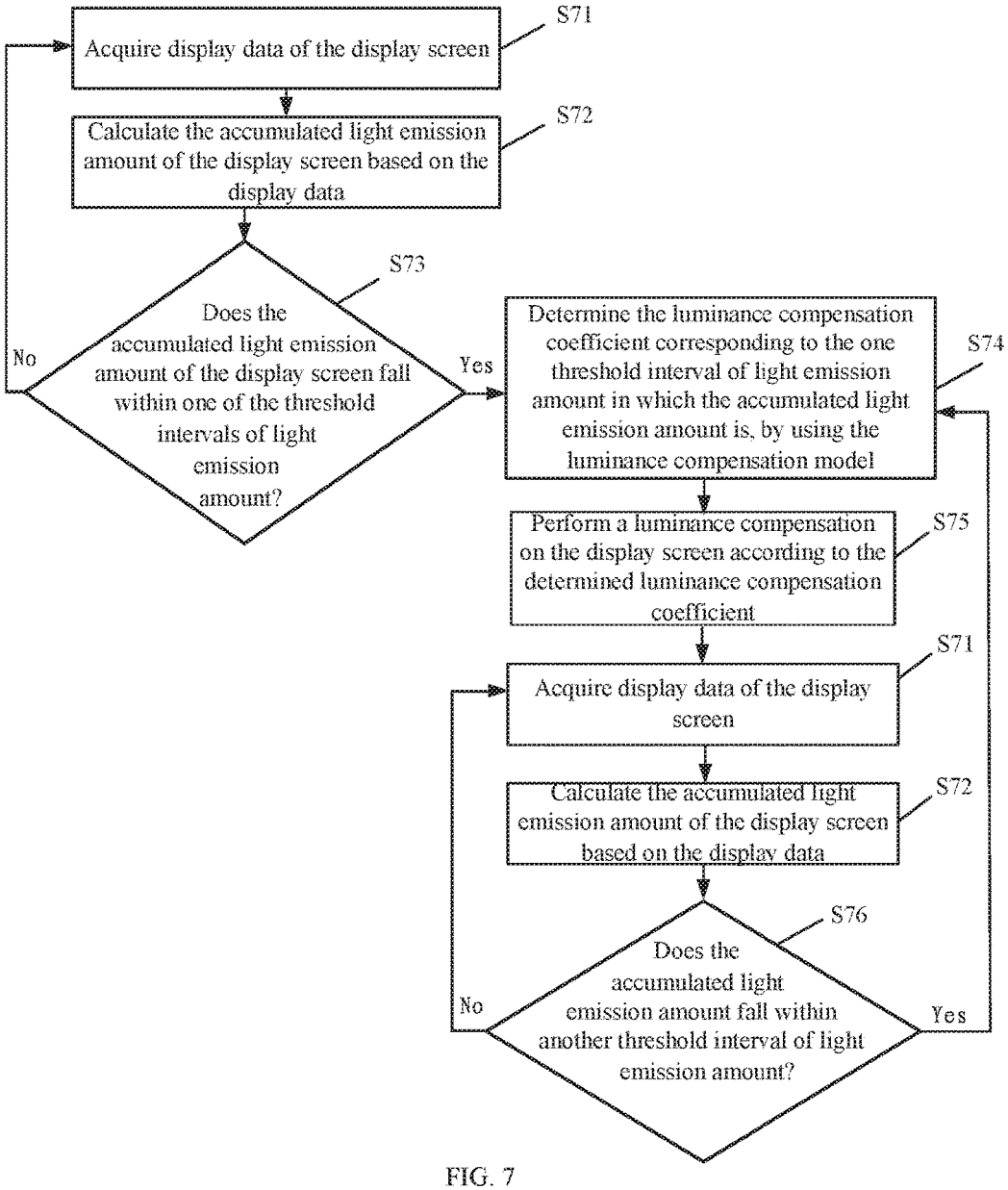
FIG. 7 shows an exemplary flow chart of a method for compensating for the luminance of a display screen in a particular embodiment.

FIG. 7 shows an exemplary flow chart of a method for compensating for the luminance of a display screen in a particular embodiment. In the exemplary embodiment, a luminance compensation is performed on the display screen on the user side. As shown in FIG. 7, the method may include steps S71-S76.

At step S71, display data of the display screen may be acquired, and the display data may be the driving data for driving the display screen, from which the display gray scale of each sub-pixel of the display screen in each frame image is acquired.

At step S72, the accumulated light emission amount of the display screen is calculated based on the display data, and in particular, for each frame image, the display gray scales of all sub-pixels of the display screen are summed, and then all the display gray scales of respective frame images are added at a predetermined time interval to acquire the accumulated light emission amount of the display screen.

At step S73, it is determined whether the accumulated light emission amount of the display screen falls within one of a plurality of predefined threshold intervals of light emission amount, and in the case that it is determined that the accumulated light emission amount of the display screen falls within the one threshold interval of light emission amount, the luminance compensation coefficient corresponding to the one threshold interval of light emission amount, in which the accumulated light emission amount is, is determined by using the luminance compensation model (S74), and in the case that it is determined that the accumulated light emission amount of the display screen does not fall within the one threshold interval of light emission amount, the compensation coefficient of the display screen is maintained, and then the display data of the display screen is continuously acquired (S71), and the accumulated light emission amount of the display screen is calculated based on the display data (S72).

It is to be noted that there may be two cases if it is determined that the accumulated light emission amount of the display screen does not fall within the one threshold interval of light emission amount. First, the total operation time of the display screen is short and the accumulated light emission amount has not yet reached a threshold interval of light emission amount, the value of which is minimum, so that there is no need for a luminance compensation on the display screen, and at this case, the accumulated light emission amount of the display screen may be continuously acquired until the accumulated light emission amount is located in one of a plurality of threshold intervals of light emission amount (for example, the first threshold interval of light emission amount). Second, the total operation time of the display screen is very long, and the accumulated light emission amount exceeds an interval of the plurality of threshold intervals of light emission amount, the value of which is maximum, such display screen is close to the level that will be scrapped, and at this case, there is no need for a luminance compensation on the display screen. The flow chart of the first case is shown in FIG. 7.

At step S74, the luminance compensation coefficient, corresponding to the threshold interval of light emission amount in which the accumulated light emission amount is located, is determined, by using the luminance compensation model.

At step S75, a luminance compensation is performed on the display screen according to the determined luminance compensation coefficient. Then, the display data of the display screen is continuously acquired (S71), and the accumulated light emission amount of the display screen is calculated based on the display data (S72) in order to determine whether the accumulated light emission amount is in another threshold interval of light emission amount.

At step S76, it is determined whether the accumulated light emission amount is in another threshold interval of light emission amount. In the case that it is determined that the accumulated light emission amount is in the another threshold interval of light emission amount, the luminance compensation coefficient, corresponding to the threshold interval of light emission amount in which the accumulated light emission amount is, is determined (S74) by using the luminance compensation model, in the case that it is determined that the accumulated light emission amount is not in the another threshold interval of light emission amount, the compensation coefficient of the display screen is maintained, then the display data of the display screen is continuously acquired (S71), and the accumulated light emission amount of the display screen is calculated based on the display data (S72).

Obviously, the method for compensating for the luminance of the display screen of the specific embodiment is particularly applicable to a display device which is easy to be aged, such as an OLED display, which is capable of performing luminance compensation on the user side, and thus it is great important for maintaining a high-quality display effect of these display devices.

As another alternative scheme, the luminance compensation model may also store only the incremental coefficient Δ of the basic luminance compensation coefficient corresponding to different accumulated light emission amount of the display screen. For example, assuming that a basic luminance compensation coefficient is X, different incremental coefficients Δ1, Δ2, Δ3 . . . for different light emission light threshold intervals may be stored in the luminance compensation model. After the light emission amount of the user screen has reached a third threshold interval of light emission amount, the corresponding incremental coefficient Δ3 may be found from the luminance compensation model, and then the basic luminance compensation coefficient X and Δ3 are multiplied to acquire the luminance compensation coefficient Δ3X corresponding to the current light emission amount of the user screen, and relevant luminance compensation is performed according to the luminance compensation coefficient Δ3X. It can be seen that, as long as the luminance compensation model stores relevant information on the luminance compensation coefficient corresponding to different accumulated light emission amount, the scheme should fall within the scope of the present disclosure.

Figure 8:
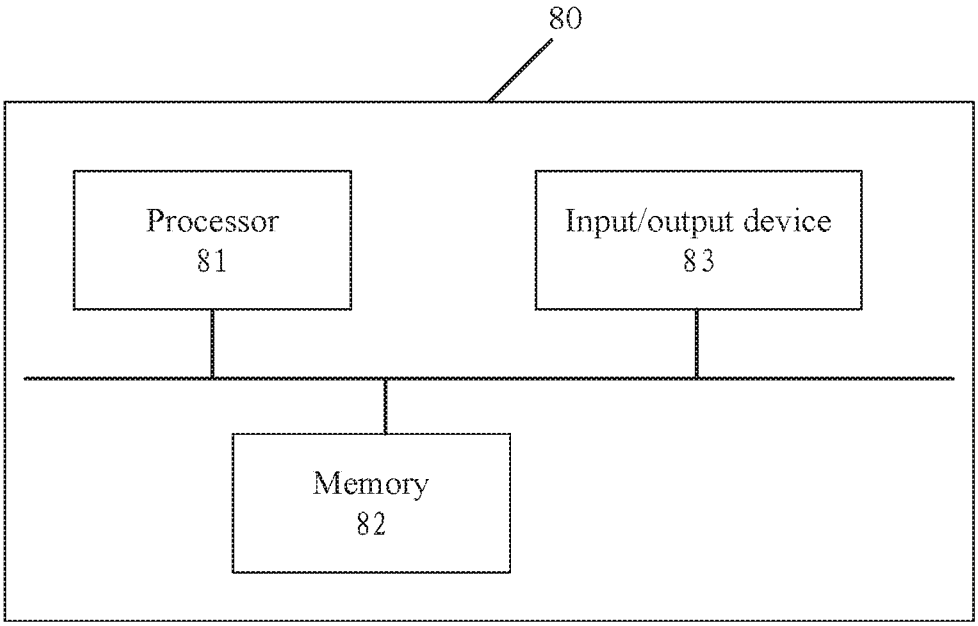
FIG. 8 shows a block diagram of a computing system for implementing an embodiment according to the present disclosure.

FIG. 8 shows a block diagram of a computing system 80 for implementing an embodiment of the present disclosure. As shown in FIG. 8, the computing system 80 may include at least one processor 81 and at least one memory 82 in which a computer program is stored. The computer program is executed by the processor 81. The processor 81 may be, for example, a central processing unit CPU, a microprocessor, a digital signal processor (DSP), a processor based on a multi-core processor architecture, and the like. The memory 82 may be any type of memory implemented by using a data storage technology, including but not limited to random access memory, read only memory, semiconductor-based memory, flash memory, disk memory, and the like.

In addition, the computing system 80 may also include an input/output device 83, such as a keyboard, a mouse, or the like.

According to the computer program stored in the memory 82, the computing system 80 may implement the apparatus for establishing a luminance compensation model for compensating for the luminance of a display screen and the apparatus for compensating for the luminance of a display screen according to the embodiments of the present disclosure.

In the case that the apparatus for establishing a luminance compensation model for compensating for the luminance of a display screen according to an embodiment of the present disclosure is implemented by the computing system 80 as shown in FIG. 8, the computer program in the memory 82, when executed by the at least one processor 81, enables the apparatus to first, acquire an accumulated light emission amount of the display screen, second, if the accumulated light emission amount of the display screen falls within one of a plurality of predefined threshold intervals of light emission amount, determine a luminance compensation coefficient for the display screen corresponding to the one threshold interval of light emission amount, and then, establish a luminance compensation model, which indicates a correlation between each of the plurality of threshold intervals of light emission amount and the corresponding luminance compensation coefficient.

In an embodiment of the present disclosure, the computer program in the memory 82, when executed by the at least one processor 81, enables the apparatus to determine the luminance compensation coefficient for the display screen corresponding to the one threshold interval of light emission amount by in the case that multiple accumulated light emission amounts fall within the one threshold interval of light emission amount, determining the luminance compensation coefficient when one of the multiple accumulated light emission amounts falls within the one threshold interval of light emission amount, as the luminance compensation coefficient for the display screen corresponding to the one threshold interval of light emission amount, alternatively, determining the luminance compensation coefficient when each of the multiple accumulated light emission amounts falls within the one threshold interval of light emission amount, and calculating a weighted average of the determined luminance compensation coefficients as the luminance compensation coefficient for the display screen corresponding to the one threshold interval of light emission amount.

In an embodiment of the present disclosure, the computer program in the memory 82, when executed by the at least one processor 81, enables the apparatus to determine the luminance compensation coefficient by controlling the display screen to display an image according to a preset display parameter, determining an actual luminance of the display screen for displaying the image, and determining the luminance compensation coefficient according to the actual luminance and a theoretical luminance, wherein the theoretical luminance is a luminance at which the display screen should theoretically display under the preset display parameter.

In an embodiment of the present disclosure, the computer program in the memory 82, when executed by the at least one processor 81, enables the apparatus to acquire the accumulated light emission amount of the display screen by: for each frame image, calculating a sum of display gray scales of all sub-pixels of the display screen, and adding the sums of the display gray scales for the respective frame images at a predetermined time interval, to acquire an accumulated display gray scale as the accumulated light emission amount of the display screen.

In the case that the apparatus for compensating for the luminance of a display screen according to an embodiment of the present disclosure is implemented by the computing system 80 as shown in FIG. 8, the computer program in the memory 82, when executed by the at least one processor 81, enables the apparatus to acquire an accumulated light emission amount of the display screen, determine a threshold interval of light emission amount corresponding to the accumulated light emission amount of the display screen, determine a luminance compensation coefficient corresponding to the determined threshold interval of light emission amount, by using the luminance compensation model established according to the embodiments therein relating to the method for establishing a luminance compensation model for compensating for the luminance of a display screen, and compensate for the luminance of the display screen based on the determined luminance compensation coefficient.

In an embodiment of the present disclosure, the computer program in the memory 82, when executed by the at least one processor 81, further enables the apparatus to further determine whether the accumulated light emission amount of the display screen falls within another threshold interval of light emission amount after the luminance of the display screen is compensated for, if the accumulated light emission amount of the display screen falls within the another threshold interval of light emission amount, determine the luminance compensation coefficient corresponding to the another threshold interval of light emission amount by using the luminance compensation model, and compensate for the luminance of the display screen based on the determined luminance compensation coefficient, if the accumulated light emission amount of the display screen does not fall within the another threshold interval of light emission amount, maintain the compensation coefficient for the display screen.

In an embodiment of the present disclosure, the computer program in the memory 82, when executed by the at least one processor 81, enables the apparatus to acquire the accumulated light emission amount of the display screen by acquiring, from driving data for displaying an image of the display screen, gray scales of all sub-pixels of the display screen in each frame image, calculating, for each frame image, a sum of the display gray scales of all sub-pixels of the display screen, and adding the sums of the display gray scales for the respective frame images at a predetermined time interval to acquire an accumulated display gray scale as the accumulated light emission amount of the display screen.

Figure 9:
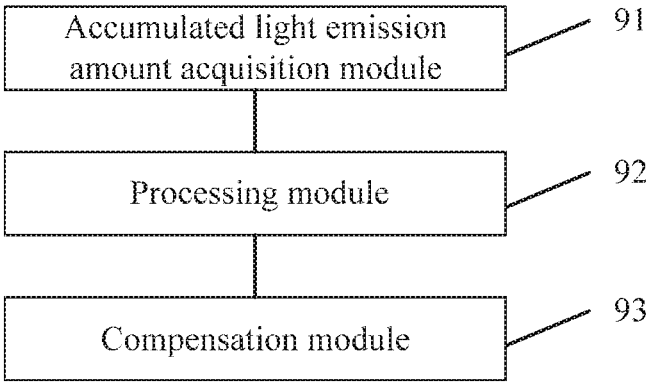
FIG. 9 shows a schematic block diagram of an apparatus for compensating for the luminance of a display screen according to an embodiment of the present disclosure.

FIG. 9 shows a schematic block diagram of an apparatus for compensating for the luminance of a display screen according to an embodiment of the present disclosure. As shown in FIG. 9, the apparatus includes an accumulated light emission amount acquisition module 91, a processing module 92 and a compensation module 93. The accumulated light emission amount acquisition module 91 is configured to acquire an accumulated light emission amount of the display screen. The processing module 92 is configured to determine a threshold interval of light emission amount corresponding to the accumulated light emission amount of the display screen, and to determine a luminance compensation coefficient corresponding to the determined threshold interval of light emission amount by using the luminance compensation model established according to the foregoing embodiments relating to the method for establishing a luminance compensation model. The compensation module 93 is configured to compensate for the luminance of the display screen based on the determined luminance compensation coefficient.

Obviously, the present embodiment may evaluate the aging stage of the display screen on the user side through the accumulated light emission amount of the screen, then find the current appropriate luminance compensation coefficient according to the established luminance compensation model, and use the luminance compensation coefficient to compensate for the luminance of the display device.

In one embodiment, the processing module 92 may be further configured to determine, for the compensated display screen, whether the accumulated light emission amount of the display screen falls within another predefined threshold interval of light emission amount, and in response to determining that the accumulated light emission amount falls within another threshold interval of light emission amount, determine the luminance compensation coefficient corresponding to the another threshold interval of light emission amount by using the luminance compensation model.

Figure 10:
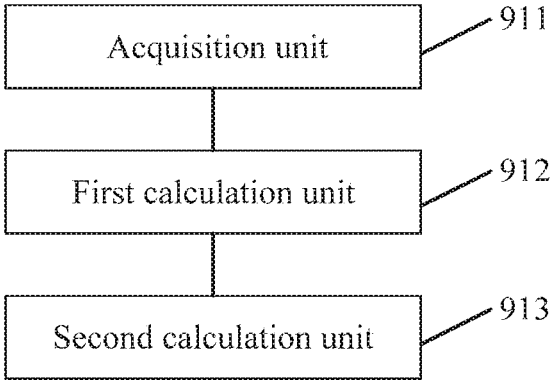
FIG. 10 shows an exemplary block diagram of an accumulated light emission amount acquisition module in the embodiment shown in FIG. 9.

FIG. 10 shows an exemplary block diagram of the accumulated light emission amount acquisition module 91 in the embodiment shown in FIG. 9. The accumulated light emission amount acquisition module may include an acquisition unit 911, a first calculation unit 912, and a second calculation unit 913. The acquisition unit 911 is configured to acquire, from the driving data for displaying an image of the display screen, gray scales of all sub-pixels of the display screen in each frame image. The first calculation unit 912 is configured to calculate, for each frame image, a sum of the display gray scales of all sub-pixels of the display screen. The second calculation unit 913 is configured to add the sums of the display gray scales for the respective frame images at a predetermined time interval to acquire an accumulated display gray scale as the accumulated light emission amount of the display screen.

In a practical application, the computing system 80 may further include a register for saving the display gray scales of all sub-pixels of the display screen for each frame. In one example, the light emission amount of the display screen may be accumulated in real time by accumulating the values in the register whenever the display gray scales of the sub-pixels in a new frame are acquired from the driving data.

Obviously, the apparatus for establishing a luminance compensation model and the apparatus for compensating for the luminance of a display screen in the embodiments of the present disclosure correspond to the method for establishing a luminance compensation model and the method for compensating for the luminance of a display screen described in one or more of the above embodiments, respectively, and thus the explanations for the methods in the embodiments herein are also suitable for the apparatuses in the embodiments herein.

In addition, the present disclosure also provides a display device including the above-described apparatus for compensating for the luminance of a display screen, and the display device is capable of automatically performing an adaptive luminance compensation according to the aging degree of the screen, thereby maintaining a higher display quality more stably.

The foregoing descriptions are alternative embodiments of the present disclosure, and it should be noted that those of ordinary skill in the art may further make various improvements and modifications without departing from the principles set forth in the present disclosure, and these improvements and modifications should also be regarded as the scope of protection of the present disclosure.

What is claimed is:

1. A method for establishing a luminance compensation model for compensating for the luminance of a display screen, the method comprising:

acquiring an accumulated light emission amount of the display screen;

if the accumulated light emission amount of the display screen falls within one of a plurality of predefined threshold intervals of light emission amount, determining a luminance compensation coefficient for the display screen corresponding to the one threshold interval of light emission amount; and establishing a luminance compensation model that indicates a correlation between each of the plurality of threshold intervals of light emission amount and the corresponding luminance compensation coefficient, wherein determining the luminance compensation coefficient for the display screen corresponding to the one threshold interval of light emission amount comprises:

in the case that multiple accumulated light emission amounts fall within the one threshold interval of light emission amount, i) determining the luminance compensation coefficient when one of the multiple accumulated light emission amounts falls within the one threshold interval of light emission amount, as the luminance compensation coefficient for the display screen corresponding to the one threshold interval of light emission amount; or ii) determining the luminance compensation coefficient when each of the multiple accumulated light emission amounts falls within the one threshold interval of light emission amount; and calculating a weighted average of the determined luminance compensation coefficients as the luminance compensation coefficient for the display screen corresponding to the one threshold interval of light emission amount.

2. The method according to claim 1, wherein determining the luminance compensation coefficient comprises:

controlling the display screen to display an image according to a preset display parameter;

determining an actual luminance of the display screen for displaying the image; and determining the luminance compensation coefficient according to the actual luminance and a theoretical luminance, wherein the theoretical luminance is a luminance at which the display screen should theoretically display under the preset display parameter.

3. The method according to claim 2, wherein acquiring the accumulated light emission amount of the display screen comprises:

calculating, for each frame image, a sum of display gray scales of all sub-pixels of the display screen; and adding the sums of the display gray scales for the respective frame images at a predetermined time interval, to acquire an accumulated display gray scale as the accumulated light emission amount of the display screen.

4. The method according to claim 1, wherein acquiring the accumulated light emission amount of the display screen comprises:

calculating, for each frame image, a sum of display gray scales of all sub-pixels of the display screen; and adding the sums of the display gray scales for the respective frame images at a predetermined time interval, to acquire an accumulated display gray scale as the accumulated light emission amount of the display screen.

5. A method for compensating for the luminance of a display screen, the method comprising:

acquiring an accumulated light emission amount of the display screen;

determining a threshold interval of light emission amount corresponding to the accumulated light emission amount of the display screen;

determining a luminance compensation coefficient corresponding to the determined threshold interval of light emission amount using the luminance compensation model established by the method according to claim 1; and compensating for the luminance of the display screen based on the determined luminance compensation coefficient.

6. The method according to claim 5, further comprising:

determining whether the accumulated light emission amount of the display screen falls within another threshold interval of light emission amount, after compensating for the luminance of the display screen;

if the accumulated light emission amount of the display screen falls within the another threshold interval of light emission amount, determining the luminance compensation coefficient corresponding to the another threshold interval of light emission amount using the luminance compensation model, and compensating for the luminance of the display screen based on the determined luminance compensation coefficient; and if the accumulated light emission amount of the display screen does not fall within the another threshold interval of light emission amount, maintaining the luminance compensation coefficient for the display screen.

7. The method according to claim 6, wherein acquiring the accumulated light emission amount of the display screen comprises:

acquiring, from driving data for displaying an image of the display screen, gray scales of all sub-pixels of the display screen in each frame image;

calculating, for each frame image, a sum of the display gray scales of all sub-pixels of the display screen; and adding the sums of the display gray scales for the respective frame images at a predetermined time interval to acquire an accumulated display gray scale as the accumulated light emission amount of the display screen.

8. The method according to claim 5, wherein acquiring the accumulated light emission amount of the display screen comprises:

acquiring, from driving data for displaying an image of the display screen, gray scales of all sub-pixels of the display screen in each frame image;

calculating, for each frame image, a sum of the display gray scales of all sub-pixels of the display screen; and adding the sums of the display gray scales for the respective frame images at a predetermined time interval to acquire an accumulated display gray scale as the accumulated light emission amount of the display screen.

9. An apparatus for compensating for the luminance of a display screen, the apparatus comprising:

at least one processor; and at least one memory in which a computer program is stored;

wherein the computer program, when executed by the at least one processor, enables the apparatus to:

acquire an accumulated light emission amount of the display screen;

determine a threshold interval of light emission amount corresponding to the accumulated light emission amount of the display screen;

determine a luminance compensation coefficient corresponding to the determined threshold interval of light emission amount using the luminance compensation model established by the method according to claim 1; and compensate for the luminance of the display screen based on the determined luminance compensation coefficient.

10. The apparatus according to claim 9, wherein the computer program, when executed by the at least one processor, enables the apparatus to:

further determine whether the accumulated light emission amount of the display screen falls within another threshold interval of light emission amount, after compensating for the luminance of the display screen;

if the accumulated light emission amount of the display screen falls within the another threshold interval of light emission amount, determine the luminance compensation coefficient corresponding to the another threshold interval of light emission amount using the luminance compensation model, and compensate for the luminance of the display screen based on the determined luminance compensation coefficient; and if the accumulated light emission amount of the display screen does not fall within the another threshold interval of light emission amount, maintain the luminance compensation coefficient for the display screen.

11. The apparatus according to claim 10, wherein the computer program, when executed by the at least one processor, enables the apparatus to acquire the accumulated light emission amount of the display screen by:

acquiring, from driving data for displaying an image of the display screen, gray scales of all sub-pixels of the display screen in each frame image;

calculating, for each frame image, a sum of the display gray scales of all sub-pixels of the display screen; and adding the sums of the display gray scales for the respective frame images at a predetermined time interval to acquire an accumulated display gray scale as the accumulated light emission amount of the display screen.

12. The apparatus according to claim 9, wherein the computer program, when executed by the at least one processor, enables the apparatus to acquire the accumulated light emission amount of the display screen by:

acquiring, from driving data for displaying an image of the display screen, gray scales of all sub-pixels of the display screen in each frame image;

calculating, for each frame image, a sum of the display gray scales of all sub-pixels of the display screen; and adding the sums of the display gray scales for the respective frame images at a predetermined time interval to acquire an accumulated display gray scale as the accumulated light emission amount of the display screen.

13. An apparatus for establishing a luminance compensation model for compensating for the luminance of a display screen, the apparatus comprising:

at least one processor; and at least one memory in which a computer program is stored, wherein when executed by the at least one processor, the computer program enables the apparatus to:

acquire an accumulated light emission amount of the display screen;

if the accumulated light emission amount of the display screen falls within one of a plurality of predefined threshold intervals of light emission amount, determine a luminance compensation coefficient for the display screen corresponding to the one threshold interval of light emission amount; and establish a luminance compensation model that indicates a correlation between each of the plurality of threshold intervals of light emission amount and the corresponding luminance compensation coefficient, wherein the computer program, when executed by the at least one processor, enables the apparatus to determine the luminance compensation coefficient for the display screen corresponding to the one threshold interval of light emission amount by:

in the case that multiple accumulated light emission amounts fall within the one threshold interval of light emission amount, i) determining the luminance compensation coefficient when one of the multiple accumulated light emission amounts falls within the one threshold interval of light emission amount, as the luminance compensation coefficient for the display screen corresponding to the one threshold interval of light emission amount; or ii) determining the luminance compensation coefficient when each of the multiple accumulated light emission amounts falls within the one threshold interval of light emission amount; and calculating a weighted average of the determined luminance compensation coefficients as the luminance compensation coefficient for the display screen corresponding to the one threshold interval of light emission amount.

14. The apparatus according to claim 13, wherein the computer program, when executed by the at least one processor, enables the apparatus to determine the luminance compensation coefficient by:

controlling the display screen to display an image according to a preset display parameter;

determining an actual luminance of the display screen for displaying the image; and determining the luminance compensation coefficient according to the actual luminance and a theoretical luminance, wherein the theoretical luminance is a luminance at which the display screen should theoretically display under the preset display parameter.

15. The apparatus according to claim 13, wherein the computer program, when executed by the at least one processor, enables the apparatus to acquire the accumulated light emission amount of the display screen by:

calculating, for each frame image, a sum of display gray scales of all sub-pixels of the display screen; and adding the sums of the display gray scales for the respective frame images at a predetermined time interval, to acquire an accumulated display gray scale as the accumulated light emission amount of the display screen.

* * * * *